US007607273B2

(12) United States Patent
Henderson

(10) Patent No.: US 7,607,273 B2
(45) Date of Patent: Oct. 27, 2009

(54) BUILDING MEMBER

(76) Inventor: Andrew G. Henderson, 414 FM 2827, Warren, TX (US) 77664

( * ) Notice: Subject to any disclaimer, the term of this patent is extended or adjusted under 35 U.S.C. 154(b) by 648 days.

(21) Appl. No.: 11/517,488

(22) Filed: Sep. 8, 2006

(65) Prior Publication Data

US 2008/0060876 A1 Mar. 13, 2008

(51) Int. Cl.
*F16B 2/02* (2006.01)

(52) U.S. Cl. ..... 52/581; 52/578; 52/838; 403/313

(58) Field of Classification Search ..... 52/581, 52/578, 589.1, 590.1, 588.1, 835, 836, 838, 52/844, 845, 848; 403/286, 292, 364, 388
See application file for complete search history.

(56) References Cited

U.S. PATENT DOCUMENTS

| | | | | | |
|---|---|---|---|---|---|
| 444,579 | A | * | 1/1891 | Jackson | 403/314 |
| 2,441,890 | A | * | 5/1948 | Larkin | 52/838 |
| 2,456,055 | A | * | 12/1948 | Farrar | 403/230 |
| 2,720,291 | A | * | 10/1955 | Larkin | 403/169 |
| 3,053,358 | A | * | 9/1962 | Gross | 52/696 |
| 3,054,482 | A | * | 9/1962 | Lassen | 52/479 |
| 3,496,690 | A | * | 2/1970 | Jahn | 52/232 |
| 3,678,642 | A | * | 7/1972 | Scott | 52/588.1 |
| 3,751,870 | A | | 8/1973 | Vesel | |
| 3,845,601 | A | | 11/1974 | Kostecky | |
| 3,900,269 | A | | 8/1975 | Pavlot | |
| 4,044,517 | A | * | 8/1977 | Schroter | 52/248 |
| 4,305,677 | A | | 12/1981 | Kowalski | |
| 4,499,697 | A | * | 2/1985 | LaLonde | 52/98 |
| 4,516,874 | A | * | 5/1985 | Yang et al. | 403/313 |
| 5,465,929 | A | * | 11/1995 | Dooley | 248/68.1 |

(Continued)

*Primary Examiner*—Richard E Chilcot, Jr.
*Assistant Examiner*—Alp Akbasli
(74) *Attorney, Agent, or Firm*—Stehen R. Greiner

(57) ABSTRACT

A building member including a male portion and a female portion that are releasably connected together. The male portion includes a first beam having a first pair of wings joined together by a first crosspiece. A first bracket has first opposed ends each of which is affixed to a respective one of the first pair of wings so as to define a first slot between the first crosspiece and the first bracket. A tongue has an inner end that is affixed to the first crosspiece and an outer end, remote from the inner end, which extends through the first slot and outwardly from the first beam. The outer end of the tongue is provided with a first hole. The female portion, however, has a second beam that is adapted for end-to-end abutment with the first beam. The second beam has a second pair of wings that are joined together by a second crosspiece. The second crosspiece is provided with a second hole that is adapted for registration with the first hole in the tongue when the first beam and the second beam abut one another end-to-end. A second bracket having second opposed ends each of which is affixed to a respective one of the second pair of wings so as to define a second slot between the second crosspiece and the second bracket. The second slot is adapted to slidably receive the outer end of the tongue. A first threaded fastener extends through the first hole in the tongue and the second hole in the second crosspiece for releasably connecting the male portion to the female portion. A second threaded fastener penetrates the first bracket and the second bracket to reinforce the connection of the male portion to the female portion.

4 Claims, 2 Drawing Sheets

U.S. PATENT DOCUMENTS 6,272,796 B1 * 8/2001 Metzler ..... 52/93.1
6,334,539 B1 * 1/2002 Jajko et al. ..... 211/42
6,389,778 B1 5/2002 Strange
6,516,583 B1 * 2/2003 Houghton ..... 52/655.1
6,550,400 B1 * 4/2003 Forbes ..... 105/458
6,729,607 B2 * 5/2004 Alberson et al. ..... 256/13.1
6,829,872 B2 * 12/2004 Wahlsteen ..... 52/741.1
2008/0196357 A1 * 8/2008 Ubinana Felix ..... 52/844

* cited by examiner

BUILDING MEMBER

FIELD OF THE INVENTION

The present invention relates generally to static structures, e.g., buildings.

BACKGROUND OF THE INVENTION

Builders are confronted with significant challenges in offering high-quality construction at competitive prices. Fluctuations in lumber costs often work against builders in making profits for their efforts. In response to marketplace uncertainties, then, steel frame construction is emerging as a preferred way to construct buildings.

More architects are now specifying steel framing for commercial and residential structures than in the past. They are attracted to the strength, termite resistance, and dimensional stability of metal. The varieties of steel dimensions and thicknesses has also grown beyond that of standard lumber, thus architects can now exhibit greater creativity in the design of buildings. Buildings with larger open spaces, longer floor spans and higher walls are the result of this combined creative effort.

Buildings constructed with steel frames have proven to be more durable than those framed with wood. In areas vulnerable to hurricanes or earthquakes, they are better able to withstand induced loads. Further, as steel is non-combustible, buildings constructed from steel readily comply with local codes and fire regulations. Because it is termite-proof, pesticide treatments are also unnecessary. Thus, health experts recommend steel framing for chemically sensitive homebuyers seeking the best possible interior air quality.

Metallic building members can be difficult to use. They are typically large and heavy, making them difficult to transport. Furthermore, because of the significantly greater density of metal relative to wood, nails cannot be employed in connecting members together and costly techniques such as welding and riveting must be employed. A need, therefore, exists for a metallic building member that can be made in small, easy-to-transport portions and quickly connected at a construction site for inclusion in a building structure as a beam, joist or rafter or, perhaps, used as a temporary form for poured concrete.

SUMMARY OF THE INVENTION

In light of the problems associated with known building members formed of metal, it is a principal object of the invention to provide a metallic building member having portions that are easily transported and connected together at a construction site. The building member, being linear, is easily plumbed and, if required, is reusable.

It is another object of the invention to provide a building member of the type described that can be deployed by both skilled and unskilled laborers with minimal instruction and without resort to any tools beyond a wrench. The building member is particularly intuitive to use.

It is an object of the invention to provide improved features and arrangements thereof in a building member for the purposes described that is lightweight in construction, inexpensive to manufacture, and dependable in use.

Briefly, the building member in accordance with this invention achieves the intended objects by featuring a male portion and a female portion that are releasably connected together. The male portion includes a first beam having a first pair of wings joined together by a first crosspiece. A first bracket has first opposed ends, each of which is affixed to a respective one of the first pair of wings so as to define a first slot between the first crosspiece and the first bracket. A tongue has an inner end that is affixed to the first crosspiece and an outer end, remote from the inner end which extends through the first slot and outwardly from the first beam. The outer end of the tongue is provided with a first hole. The female portion, however, has a second beam that is adapted for end-to-end abutment with the first beam. The second beam has a second pair of wings that are joined together by a second crosspiece. The second crosspiece is provided with a second hole that is adapted for registration with the first hole in the tongue when the first beam and the second beam abut one another end-to-end. A second bracket having second opposed ends each of which is affixed to a respective one of the second pair of wings so as to define a second slot between the second crosspiece and the second bracket. The second slot is adapted to slidably receive the outer end of the tongue. A first threaded fastener extends through the first hole in the tongue and the second hole in the second crosspiece for releasably connecting the male portion to the female portion. A second threaded fastener penetrates the first bracket and the second bracket to reinforce the connection of the male portion to the female portion.

In an alternative embodiment of the building member the tongue is provided with at least one notch that can slidably receive a threaded rod and nut being affixed to the second crosspiece as a substitute for the first threaded fastener of the embodiment summarized in the previous paragraph.

The foregoing and other objects, features, and advantages of the present invention will become readily apparent upon further review of the following detailed description of the preferred embodiments as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENTS

Figure 1:
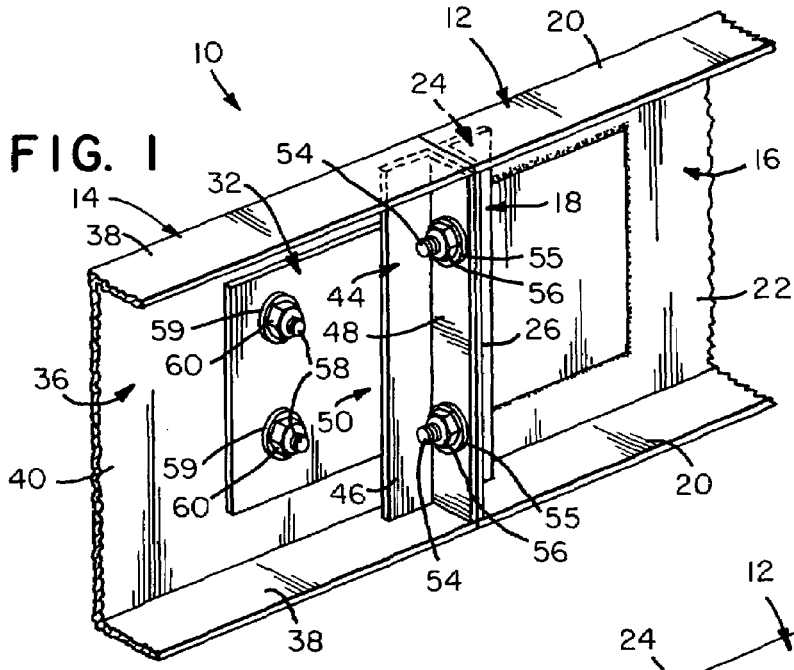
FIG. 1 is a perspective view of a building member in accordance with the present invention with the male and female portions thereof being joined together.
Figure 2:
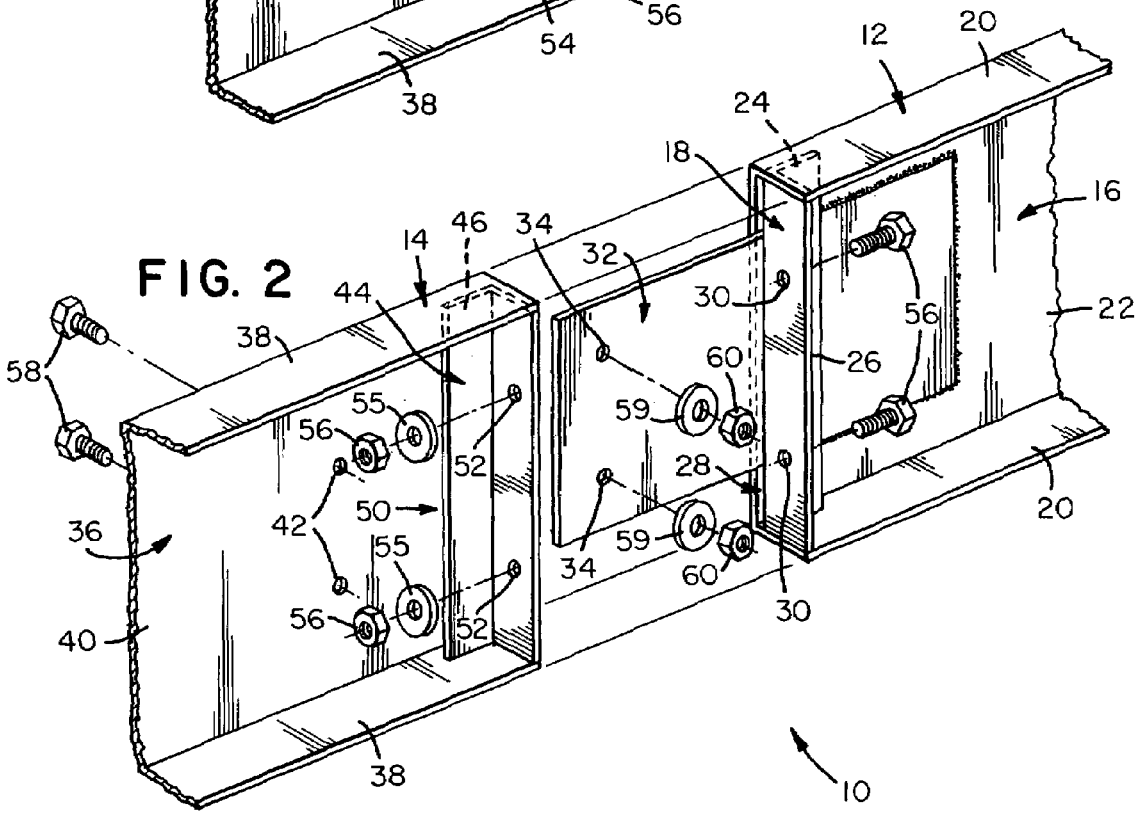
FIG. 2 is a perspective view of the building member of FIG. 1 with the male and female portions thereof being disengaged.

Referring now to FIGS. 1 and 2, a building member in accordance with the present invention is shown at 10. Building member 10 includes a male portion 12 and a female portion 14 that are mated end to end. Once mated, threaded fasteners are employed to selectively join male portion 10 and female portion 12 for an indefinite period.

Male portion 12 includes a beam 16 that is stiffened at one end by a bracket 18. Beam 16 has a pair of parallel wings 20 joined by a crosspiece 22 into a C-shaped arrangement. Bracket 18 is affixed between wings 20 and has a leg 24 and a leg 26 being joined in an L-shaped arrangement, i.e., joined at right angles. As shown, leg 24 is oriented parallel to crosspiece 22 and is spaced a short distance therefrom so as to define a slot 28 between leg 24 and crosspiece 22. Leg 26, however, extends away from slot 28, flush with the outer ends of wings 20, and is provided with a pair of apertures 30.

Male portion 12 features a tongue 32 that extends through slot 28 and outwardly from beam 16. Tongue 32 is a rectangular plate whose inner end is affixed, as by welding, to crosspiece 22 between wings 20. The outer end of tongue 32 is positioned remote from bracket 18 and is pierced by a pair of holes 34. If desired, slot 28 can be configured with substantially the same width or thickness as tongue 32 so that tongue 32 can be affixed directly to bracket 18 for additional reinforcement.

Female portion 14 includes a beam 36 having a pair of parallel wings 38 joined by a crosspiece 40 into a C-shaped arrangement sized for close, end-to-end contact with beam 16. Crosspiece 40 is provided with a pair of holes 42 adapted for registration with holes 34 in tongue 32 when portions 12 and 14 are mated.

A bracket 44 stiffens one end of beam 36. Bracket 44 is affixed between wings 38 and has a leg 46 and a leg 48 being joined at right angles. Leg 46 is oriented parallel to crosspiece 40 and is spaced a therefrom so as to define a slot 50 between leg 46 and crosspiece 40 that is substantially the same height as slot 28. Leg 48, however, extends away from slot 50, flush with the outer ends of wings 38, and is provided with a pair of apertures 52 adapted for registration with apertures 30 in leg 26.

The use of building member 10 is straightforward. First, portions 12 and 14 of suitable dimensions for use, say as a floor joist, are hauled to a construction site. Next, the ends of beams 16 and 36 bearing brackets 18 and 44 are brought towards one another so that wings 20 and 38 and crosspieces 22 and 40 are respectively positioned in axial alignment. Then, tongue 32 is slid into slot 50. Now, a pair of bolts 54 is extended through axially aligned apertures 30 and 52 in brackets 18 and 44 and is set firmly in place by tightening one of a pair of nuts 56 onto each of bolts 54. Afterward, a pair of bolts 58 is extended through axially aligned holes 34 and 42 in crosspiece 40 and tongue 32 and is set firmly in place by tightening one of a pair of nuts 60 onto each of bolts 58. Finally, building member 10 can be moved into position where it is connected at its opposite ends to a suitable foundation. Thus, a floor system of great strength can be constructed from relatively small, easy to transport pieces.

Figure 3:
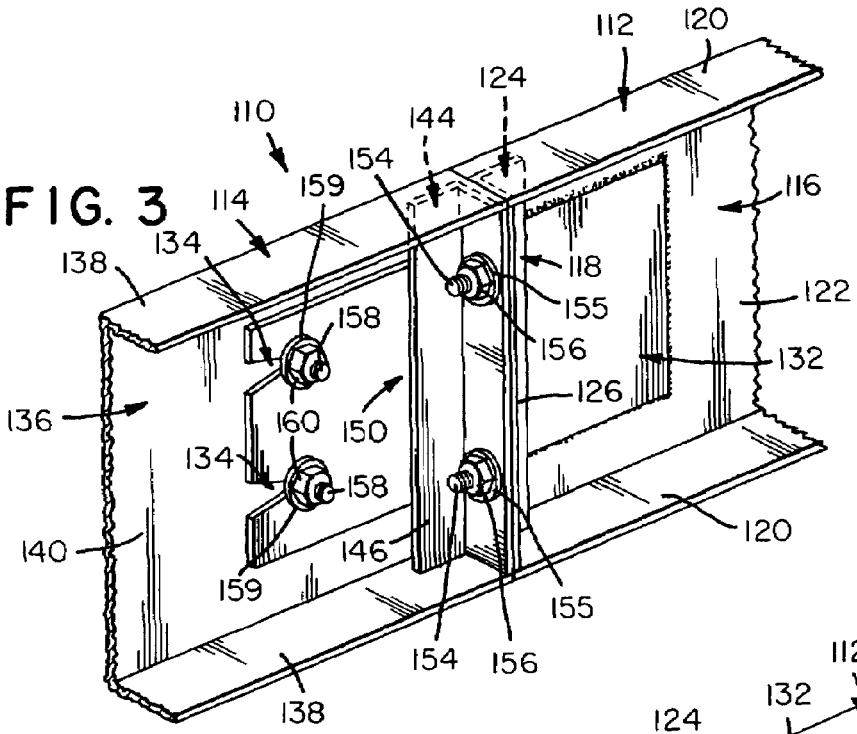
FIG. 3 is a perspective view of another building member in accordance with the present invention with the male and female portions thereof being joined together.
Figure 4:
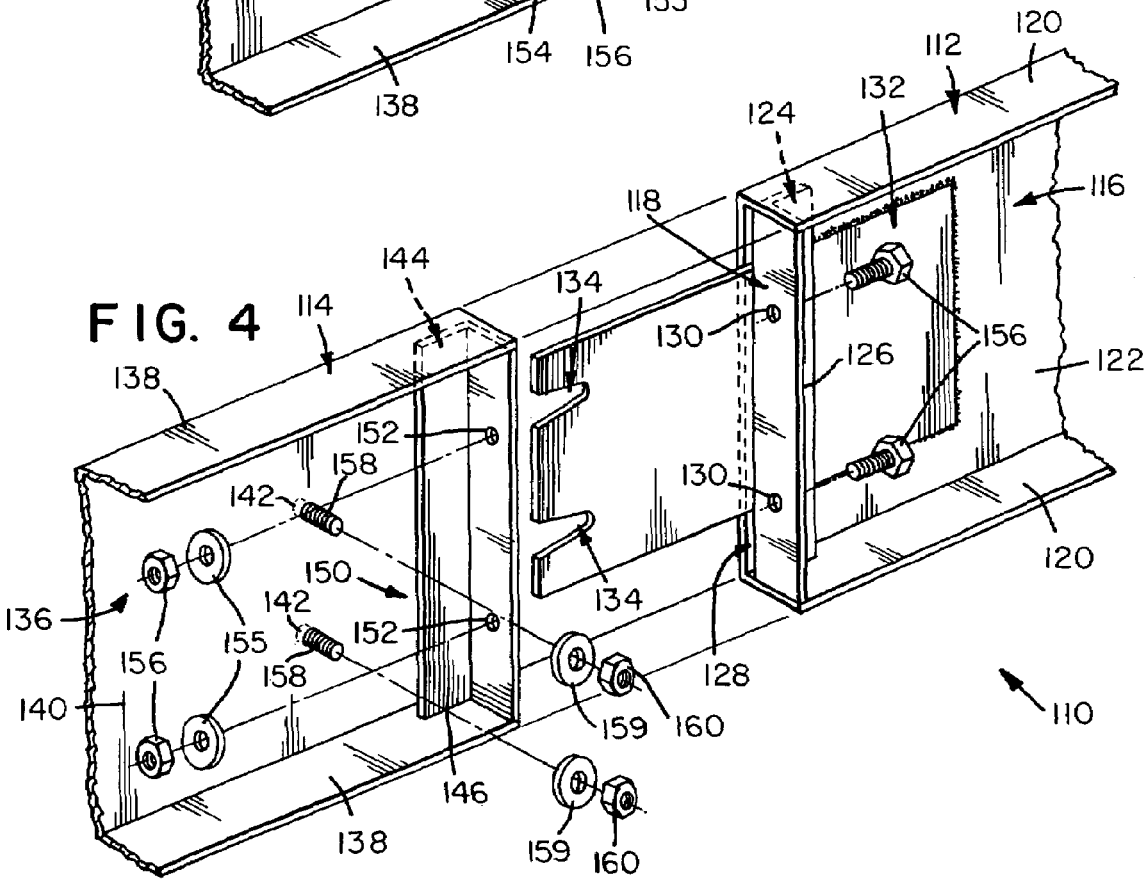
FIG. 4 is a perspective view of the building member of FIG. 3 with the male and female portions thereof being disengaged.

Referring now to FIGS. 3 and 4, an alternative building member in accordance with the present invention is shown at 110. Building member 110 includes a male portion 112 and a female portion 114 that are mated end to end. Once mated, threaded fasteners are employed to selectively join male portion 112 and female portion 114.

Male portion 112 includes a beam 116 that is stiffened at one end by a bracket 118. Beam 116 has a pair of parallel wings 120 joined by a crosspiece 122 into a C-shaped arrangement. Bracket 118 is affixed between wings 120 and has a leg 124 and a leg 126 being joined at right angles. Leg 124 is oriented parallel to crosspiece 122 and is spaced a short distance therefrom so as to define a slot 128 between leg 124 and crosspiece 122. Leg 126, on the other hand, extends away from slot 128, flush with the outer ends of wings 120, and is provided with a pair of spaced-apart apertures 130.

Male portion 112 features a tongue 132 that extends through slot 128 and outwardly from beam 116. Tongue 132 is a rectangular plate whose inner end is affixed to crosspiece 122 between wings 120. The outer end of tongue 132 is positioned remote from bracket 118 and has a pair of adjacent notches 134 that extend inwardly toward beam 116. Each of notches 134 tapers in width from a wide outer end 135 to a narrow inner end 137.

Female portion 114 includes a beam 136 having a pair of parallel wings 138 joined by a crosspiece 140 into a C-shaped arrangement sized for close, stable, end-to-end contact with beam 116. Crosspiece 140 is provided with a pair of holes 142 each of which is adapted for registration with a respective one of the inner ends 137 of notches 134 when portions 112 and 114 are mated. Affixed within each of holes 142 is the inner end of a respective one of a pair of threaded rods 158. As shown, rods 158 extend outwardly from holes 142 and between wings 138 so that such can be fitted within notches 134 in tongue 132.

A bracket 144 stiffens the end of beam 136 adjacent threaded rods 158. Bracket 144 is affixed between wings 138 and has a leg 146 and a leg 148 being joined at right angles. Leg 146 is oriented parallel to crosspiece 140 and is spaced a therefrom so as to define a slot 150 between leg 146 and crosspiece 140 that is substantially the same height as slot 150. Leg 148, however, extends away from slot 150, flush with the outer ends of wings 138, and is provided with a pair of apertures 152 adapted for registration with apertures 130 in leg 126.

Portions 112 and 114 (like portions 12 and 14) are made of metal that has been rolled, cast, stamped or otherwise formed as described hereinabove. The dimensions of these features are a matter of design choice being dependent upon factors many factors such as: intended use, expected loads, ease of transport, assembly speed, anticipated project longevity, and cost. Of course, any suitable material can be used, but steel alloys have found widespread acceptance in the building trades due to its great strength and durability indoors and out. Welding is the preferred method of affixing one feature to another.

The use of building member 110 is as straightforward as that of building member 110. First, portions 112 and 114 of suitable dimensions for use, say as a concrete form, are transported to a construction site. Next, the ends of portions 112 and 114 bearing brackets 132 and 144 are brought toward one another so that wings 120 and 138 and crosspieces 122 and 140 are respectively positioned in axial alignment. Then, tongue 132 is slid into slot 150 such that threaded rods 158 are received into inner ends 137 of notches 134. Now, a pair of bolts 154 is extended through axially aligned apertures 130 and 152 in brackets 118 and 144 and is set firmly in place by tightening one of a pair of nuts 156 onto each of bolts 154. Afterward, threaded rods 158 are fixed within notches 134 by tightening one of a pair of nuts 160 onto each of rods 158. Finally, with portions 112 and 114 mated together as a single unit, building member 110 is moved into position where outer sides of crosspieces 122 and 140 can support concrete while such is poured and smoothed into a slab. When the concrete has cured, the nuts 154 and 156 are removed from bolts 154 and rods 158 so that portions 112 and 114 can be detached from one another for storage and immediate reuse. Thus, concrete slabs and curbing can be readily made with forms assembled from relatively small, easy to transport, and easy to connect pieces.

While building members 10 and 110 have been described with a high degree of particularity, it will be appreciated by those skilled in the art that modifications can be made to them. For example, beams 16, 36, 116, and 136 can be provided with connecting features at each of their opposite ends, rather than at just one end as described above for the sake of convenience. Also, the beams can have any cross-sectional configuration such as, for example, that provided by I-beams. Of course, the number and location of holes 34, 42, 134 and 142 and apertures 30, 52, 130 and 152 can be varied in accordance with need. Therefore, it is to be understood that the present invention is not limited to the pair of building member embodiments described above, but encompasses any and all embodiments within the scope of the following claims.

I claim:

1. A building member, comprising:

a male portion including:

a first beam having a first pair of wings being joined together by a first crosspiece;

a first bracket having first opposed ends each of which being affixed to a respective one of said first pair of wings so as to define a first slot between said first crosspiece and said first bracket; and, a tongue having an inner end being affixed to said first crosspiece and an outer end, remote from said inner end, extending through said first slot and outwardly from said first beam, said outer end being provided with a first hole;

a female portion being releasably connected to said male portion, said female portion including:

a second beam being adapted for end-to-end abutment with said first beam, said second beam having a second pair of wings being joined together by a second crosspiece, and said second crosspiece being provided with a second hole being adapted for registration with said first hole in said tongue when said first beam and said second beam abut one another end-to-end; and, a second bracket having second opposed ends each of which being affixed to a respective one of said second pair of wings so as to define a second slot between said second crosspiece and said second bracket, said second slot being adapted to slidably receive said outer end of said tongue; and, a first threaded fastener extending through said first hole in said tongue and said second hole in said second crosspiece for releasably connecting said male portion to said female portion.

2. The building member according to claim 1 wherein said first bracket is provided with a first aperture therein and said second bracket is provided with a second aperture therein and said building member further comprises a second threaded fastener extending through said first aperture and said second aperture for releasably connecting said male portion to said female portion.

3. A building member, comprising:

a male portion including:

a first beam having a first pair of wings being joined together by a first crosspiece;

a first bracket having first opposed ends each of which being affixed to a respective one of said first pair of wings so as to define a first slot between said first crosspiece and said first bracket; and, a tongue having an inner end being affixed to said first crosspiece and an outer end, remote from said inner end, extending through said first slot and outwardly from said first beam, said outer end being provided with a notch therein;

a female portion being releasably connected to said male portion, said female portion including:

a second beam being adapted for end-to-end abutment with said first beam, said second beam having a second pair of wings being joined together by a second crosspiece, and said second crosspiece being provided with a hole being adapted for registration with said notch in said tongue when said first beam and said second beam abut one another end-to-end;

a threaded rod extending from said hole and being affixed to said second crosspiece, said threaded rod being adapted for slidable positioning within said notch in said tongue; and, a second bracket having second opposed ends each of which being affixed to a respective one of said second pair of wings so as to define a second slot between said second crosspiece and said second bracket, said second slot being adapted to slidably receive said outer end of said tongue; and, a nut threadably positioned upon said threaded rod for releasably connecting said male portion to said female portion.

4. The building member according to claim 3 wherein said first bracket is provided with a first aperture therein and said second bracket is provided with a second aperture therein and said building member further comprises a threaded fastener extending through said first aperture and said second aperture for releasably connecting said male portion to said female portion.

* * * * *